US010999671B2

(12) United States Patent
Masui

(10) Patent No.: US 10,999,671 B2
(45) Date of Patent: May 4, 2021

(54) HEADPHONES

(71) Applicant: YAMAHA CORPORATION, Hamamatsu (JP)

(72) Inventor: Hideyoshi Masui, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/570,005

(22) Filed: Sep. 13, 2019

(65) Prior Publication Data

US 2020/0007976 A1 Jan. 2, 2020

Related U.S. Application Data

(63) Continuation of application No. PCT/JP2017/010592, filed on Mar. 16, 2017.

(51) Int. Cl.

| | |
|---|---|
| ***H04R 1/10*** | (2006.01) |
| ***H04R 3/04*** | (2006.01) |
| ***G10K 11/178*** | (2006.01) |

(52) U.S. Cl.

CPC ..... *H04R 1/1083* (2013.01); *G10K 11/17821* (2018.01); *H04R 3/04* (2013.01)

(58) Field of Classification Search

CPC ..... H04R 1/1083; H04R 3/04; H04R 1/1016; H04R 1/1041; G10K 11/17821; G10K 2210/1081

USPC ..... 381/71.6, 71.1, 71.8, 71.7, 122, 91, 98, 381/97, 104, 99, 101, 102, 106, 107; 345/177, 173; 455/41.2, 90.3

See application file for complete search history.

(56) References Cited

U.S. PATENT DOCUMENTS

| | | | | |
|---|---|---|---|---|
| 8,204,241 | B2 | 6/2012 | Asada | |
| 9,053,709 | B2 | 6/2015 | Chinen | |
| 2008/0285388 | A1* | 11/2008 | Ohguri | G08C 23/02 367/198 |
| 2012/0157860 | A1* | 6/2012 | Suzuki | A61B 5/4818 600/484 |
| 2015/0023510 | A1 | 1/2015 | Shimizu | |

(Continued)

FOREIGN PATENT DOCUMENTS

| | | | |
|---|---|---|---|
| JP | H10200610 | A | 7/1998 |
| JP | 2003143683 | A | 5/2003 |

(Continued)

OTHER PUBLICATIONS

International Search Report issued in International Application No. PCT/JP2017/010592 dated May 30, 2017. English translation provided.

(Continued)

*Primary Examiner* — Vivian C Chin
*Assistant Examiner* — Con P Tran
(74) *Attorney, Agent, or Firm* — Rossi, Kimms & McDowell LLP

(57) ABSTRACT

Headphones include: a speaker configured to output sound based on an input signal; a microphone configured to receive touch sound produced when a touch is performed on a user; and a command output device configured to, on the basis of a sound signal derived from the touch sound received by the microphone, determine a touch operation corresponding to the touch performed on the user, to output a command corresponding to the touch operation.

3 Claims, 4 Drawing Sheets

(56) References Cited

U.S. PATENT DOCUMENTS

| | | | | |
|---|---|---|---|---|
| 2015/0131814 | A1 | 5/2015 | Usher | |
| 2017/0374188 | A1* | 12/2017 | Chalabi | H04M 1/6033 |
| 2019/0094966 | A1* | 3/2019 | Kulkarni | G06N 20/00 |

FOREIGN PATENT DOCUMENTS

| | | | |
|---|---|---|---|
| JP | 2008166897 | A | 7/2008 |
| JP | 2011123751 | A | 6/2011 |
| JP | 2015023499 | A | 2/2015 |

OTHER PUBLICATIONS

Written Opinion issued in International Application No. PCT/JP2017/010592 dated May 30, 2017.

Office Action issued in Japanese Appln. No. 2019-505610 dated Oct. 6, 2020. English machine translation provided.

* cited by examiner

HEADPHONES

CROSS REFERENCE TO RELATED APPLICATIONS

This application is a continuation application of PCT Application No. PCT/JP2017/010592, filed Mar. 16, 2017, the entire contents of which are incorporated herein by reference.

BACKGROUND

Technical Field

The present disclosure relates to headphones.

Background Information

In recent years, portable playback devices, such as a smartphone, are in widespread use. A user of a playback device often puts on headphones indoors or outdoors in order to listen to sound based on a signal output from the playback device. In such a situation, it is bothersome for the user to manipulate an operation element of the headphone or the playback device in order to provide instructions to the headphone or the playback device.

Accordingly, a technique has been proposed that provides an instruction in response to a command that is output on the basis of a detection result of an acceleration sensor that detects knocking (tapping) on a casing of a headphone into which an acceleration sensor is incorporated (for example, refer to Japanese Patent Application Laid-Open Publication No. 2003-143683).

However, in techniques that detect knocking on the casing to output a command, a position of the casing, that is, a position of the headphones on the user of the headphones may shift due to the knocking on the casing. In this case, the user needs to move the headphones back to the original position, and this is inconvenient for the user.

SUMMARY

The present disclosure has been made in view of such circumstances. An object of the present disclosure is to provide a technique that avoids reduction in usability for a user of a headphone.

In order to achieve the above object, a headphone according to an aspect of the present disclosure includes a speaker configured to output sound based on an input signal, a microphone configured to receive touch sound produced when a touch is performed on a user, and a command output device configured to, on the basis of a sound signal derived from the touch sound received by the microphone, determine a touch operation corresponding to the touch made on the user, to output a command corresponding to the touch operation.

DESCRIPTION OF THE EMBODIMENTS

Hereinafter, embodiments according to the disclosure will be described with reference to the drawings.

Figure 1:
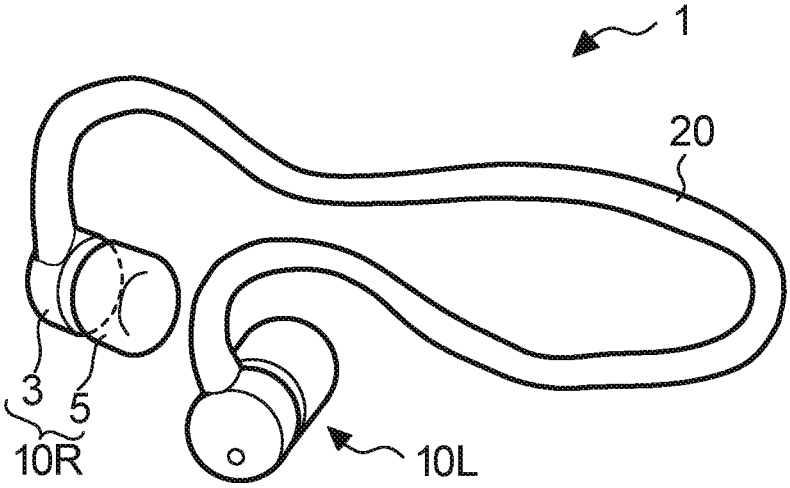
FIG. 1 is a view showing headphones according to a first embodiment.

FIG. 1 is a view showing headphones 1 according to a first embodiment. The headphones 1 include a right unit 10R for the right ear, a left unit 10L for the left ear, and a band 20 that connects the right unit 10R and the left unit 10L.

The right unit 10R includes a base unit 3 and an earpiece 5. The base unit 3 is formed of a hard material, such as plastic, in a cylindrical shape. The base unit 3 is fixed to one end of the band 20. The earpiece 5 is formed of an elastic material such as urethane and sponge. The earpiece 5 is installed on the base unit 3.

In a manner similar to the right unit 10R, the left unit 10L includes a base unit and an earpiece.

Figure 2:
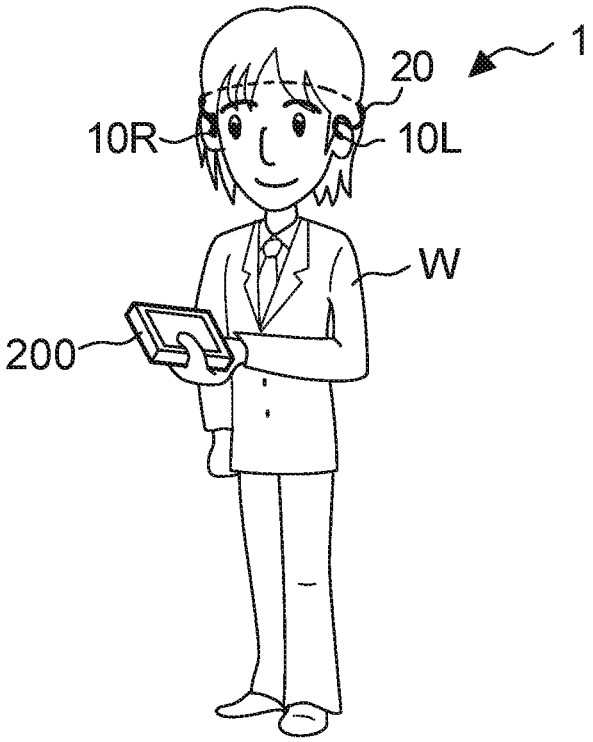
FIG. 2 is a view showing a state of use of the headphones according to the first embodiment.

FIG. 2 is a view showing a state of use of the headphones 1. Here, it is assumed that a user W carries a playback device 200, such as a smartphone etc., and listens to music or the like played by the playback device 200 using the headphones 1. The playback device 200 is an example of an external device.

In this case, the user W puts on the headphones 1 as follows. The user W pulls the band 20 behind the user's ears, with the right unit 10R and the left unit 10L facing forward. Then, the user W inserts the earpiece 5 of the right unit 10R into the right external auditory canal of the user, and inserts the earpiece 5 of the left unit 10L into the left external auditory canal of the user, thereby putting on the headphones 1.

Figure 3:
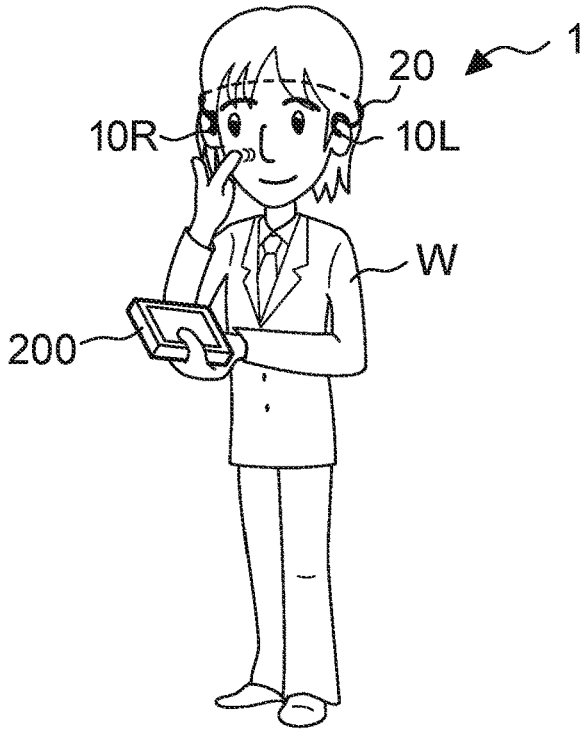
FIG. 3 is a diagram showing an example in which a command is input.

FIG. 3 is a view showing an example of a manipulation by a user to input a command to the headphones 1. In the embodiment, the user W wearing the headphones 1 inputs a command as follows. Specifically, the user W inputs a command by knocking (tapping) on a part of the user's body using the user's finger or the like. The part of the body of user W is a vicinity of the headphones 1 being worn by the user W, and is, for example, the right cheek in the drawing. In the first embodiment, assumed to be a command, is an instruction to control the headphones 1, such as a mute instruction, or an instruction to process a signal in the headphones 1.

Figure 4:
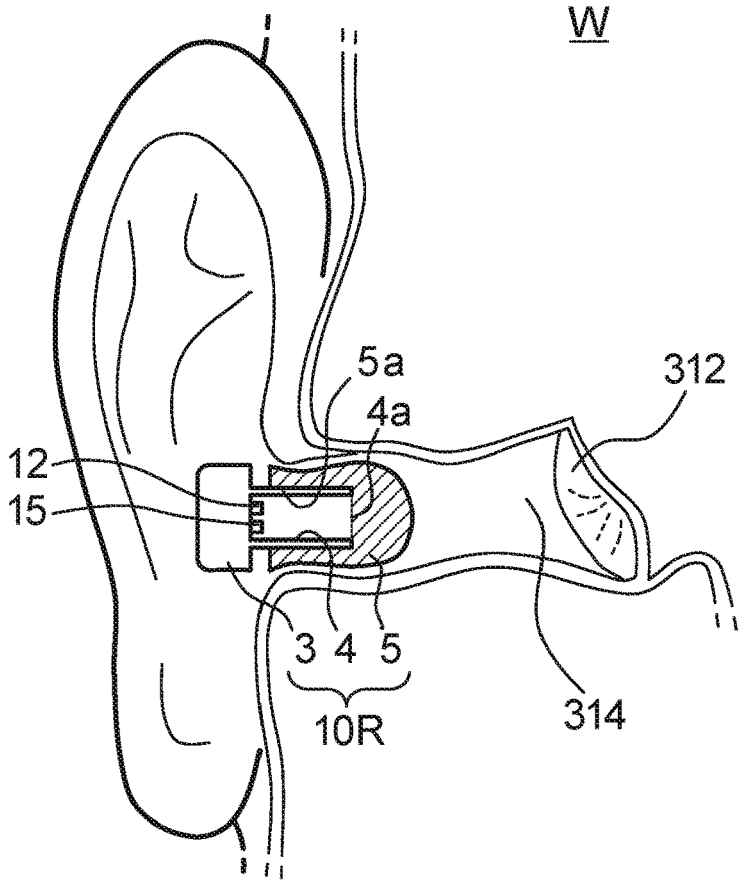
FIG. 4 is a detailed view showing a state of use of the headphones according to the first embodiment.

FIG. 4 is a view showing a configuration of the headphone 1 in the state of use, in particular, a view showing a state in which the right unit 10R is attached to the right ear.

A microphone 12 and a speaker 15 are provided on one of the two bottom surfaces of the cylindrical base unit 3, specifically, on the bottom surface on which the earpiece 5 is arranged. A cylindrical port 4 having an opening 4*a* is unitarily formed with, for example, the base unit 3, so as to enclose the microphone 12 and the speaker 15.

The earpiece 5 is formed of an elastic material in the shape of a dome or in the shape of a shell, for example. A hole 5*a* is provided in the earpiece 5. The earpiece 5 is attached to the base unit 3 so that the port 4 is covered by an inner circumferential surface of the hole 5*a*. When the headphones 1 are used, the tip of the earpiece 5 is inserted into an external auditory canal 314 of the user, as shown in the figure.

More specifically, with respect to the right unit 10R, the earpiece 5 is inserted into the external auditory canal 314 of a user such that the tip of the earpiece 5 does not reach tympanic membrane 312, with one end of the base unit 3 exposed from the external auditory canal 314. In this state, the microphone 12 receives sound output from the speaker 15 in a closed space formed by closing off the external auditory canal 314 with the earpiece 5. The microphone 12 further receives ambient sound transmitted through the base unit 3, and the earpiece 5, etc.

In FIG. 4, the band 20 is omitted for the sake of convenience.

Next, electrical configuration of the headphones 1 will be described.

Figure 5:
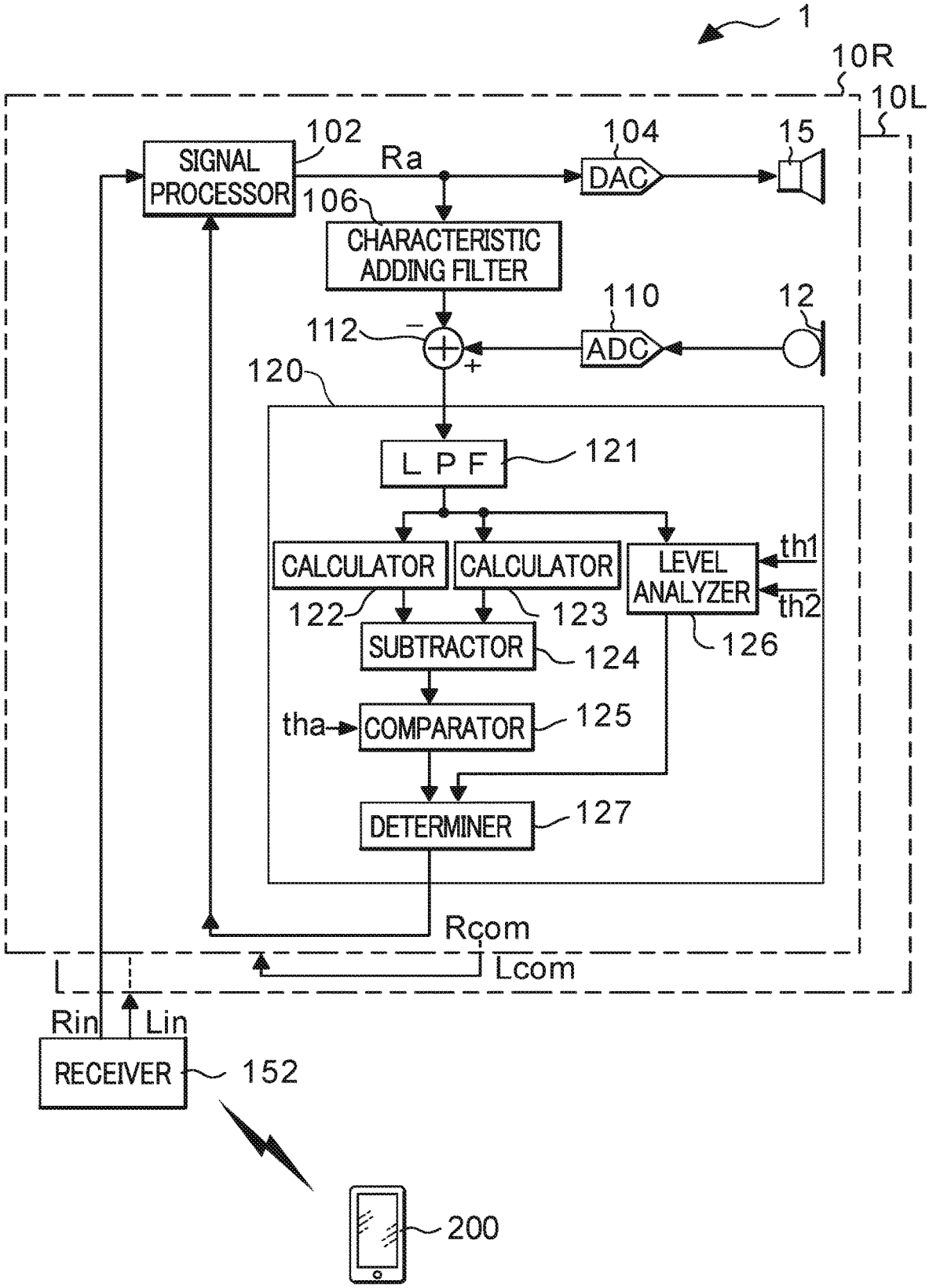
FIG. 5 is a block diagram showing an electrical configuration of the headphones according to the first embodiment.

FIG. 5 is a block diagram showing an electrical configuration of the headphones 1.

A receiver 152 is incorporated into, for example, the band 20. The receiver 152 receives a stereo signal reproduced by the playback device 200, for example, wirelessly. The receiver 152 supplies a signal Rin of the stereo signal to the right unit 10R, and supplies a signal Lin of the stereo signal to the left unit 10L.

The receiver 152 may be incorporated into one of the right unit 10R and the left unit 10L instead of the band 20. The receiver 152 may receive the signals Lin and Rin from the playback device 200 through a wire instead of receiving them wirelessly.

The right unit 10R in the headphone 1 includes a signal processor 102, a digital-to-analog converter (DAC) 104, a characteristic imparting filter 106, an analog-to-digital converter (ADC) 110, a subtractor 112, and a command output device 120, in addition to the microphone 12 and the speaker 15 described above. These elements are provided, for example, in the base unit 3 of the right unit 10R.

The signal processor 102 generates a signal Ra by performing a processing corresponding to a command Rcom on the signal Rin. The signal processor 102 supplies the signal Ra to each of the DAC 104 and the characteristic imparting filter 106. A mute processing for changing to a silent state is assumed, for example, as the processing corresponding to the command Rcom. However, the processing corresponding to the command Rcom is not limited to mute processing.

The DAC 104 converts the signal Ra into an analog signal and supplies the analog signal to the speaker 15. The speaker 15 converts the analog signal output from the DAC 104 into air vibrations, that is, sound. The speaker 15 outputs the sound.

The microphone 12 receives sound at a position at which the microphone 12 is arranged (refer to FIG. 4). The microphone 12 generates a sound signal in accordance with the received sound. The microphone 12 supplies the sound signal to the ADC 110.

The ADC 110 converts the sound signal into a digital signal and supplies the digital signal to an addition input terminal (+) of the subtractor 112.

An output signal of the characteristic imparting filter 106 is supplied to a subtraction input terminal (−) of the subtractor 112. Therefore, the subtractor 112 generates a subtraction signal by subtracting the output signal of the characteristic imparting filter 106 from the output signal of the ADC 110. The subtraction signal is supplied to the command output device 120.

Here, the subtractor 112 subtracts the output signal of the characteristic imparting filter 106 from the output signal of the ADC 110. Alternatively, the output signal of the characteristic imparting filter 106 may be multiplied by a coefficient "−1," and then the multiplication result may be added to the output signal of the ADC 110.

The characteristic imparting filter 106 has a transfer characteristic equivalent to a change in sound caused in a situation in which the sound propagates through a path from the speaker 15 to the microphone 12 in the external auditory canal 314. The characteristic is determined based on a simulated result of the path. More specifically, the characteristic imparting filter 106 imparts, to the signal Ra representing sound that is to be output by the speaker 15, a component based on the change (due to reflection and attenuation of the sound, etc.) caused in the situation in which the sound output by the speaker 15 propagates through the path.

The subtractor 112 subtracts the output signal of the filter 106 from the output signal of the ADC 110, i.e., a signal based on sound received by the microphone 12. The output signal of the filter 106 is obtained by imparting the components of the change described above to the signal Ra. The output signal of the ADC 110 is based on the signal in accordance with sound received by the microphone 12. Accordingly, in the subtraction signal, a component of the sound output from the speaker 15 (and has reached the microphone 12) is canceled out.

Here, the sound received by the microphone 12 also includes the ambient sound transmitted through the base unit 3, the earpiece 5 and the body of user W. Therefore, when both the component based on the sound output from the speaker 15 and the components of the change described above are canceled out from the sound signal that is output from the microphone 12, the remaining signal represents the ambient sound. The ambient sound includes noise (environmental sounds) surrounding the user W and knocking sound produced by knocking on the user W, etc. The knocking sound is an example of a touch (contact) sound. The knocking on the user W is an example of a touch (contact) with the user W.

The command output device 120 detects the knocking sound from the ambient sound on the basis of the subtraction signal. The command output device 120 outputs a command Rcom in response to the detection. The command output device 120 is, for example, a processor.

The knocking sound due to the knocking on the cheek has the following characteristics. Specifically, first, the knocking sound is an abrupt sound. Although not specifically shown in the Drawings, when a time is on the horizontal axis and amplitude is on the vertical axis with respect to a waveform of a signal that represents a knocking sound, a noise spike will be exhibited at the time when knocking occurs.

Second, when the frequency of the knocking sound is analyzed, the level (power) of a component of 100 Hz or less continues in a substantially constant state for about 100 milliseconds after the knocking occurs.

In order to detect such a knocking sound, the command output device 120 includes a low pass filter (LPF) 121, calculators 122 and 123, a subtractor 124, a comparator 125, a level analyzer 126, and a determiner 127.

The LPF 121 passes a component of frequency of 100 Hz or less in the subtraction signal. Further, the LPF 121 reduces a component that exceeds 100 Hz in the subtraction signal.

The calculator 122 calculates a short-time-average value by averaging the amplitude of the output signal of the LPF 121 over a short period of time. The calculator 123 calculates a long-time-average value by averaging the amplitude of the output signal of the LPF 121 over a period of time longer than the short period of time.

The subtractor 124 subtracts the long-time-average value from the short-time-average value. The comparator 125 compares a subtraction result output from the subtractor 124 with an amplitude threshold value thA. When the subtraction result is greater than or equal to the amplitude threshold value thA, the comparator 125 supplies a comparison result indicating that the subtraction result is greater than or equal to the amplitude threshold value thA to the determiner 127.

Here, when an abrupt sound is not received by the microphone 12, the short-time-average value and the long-time-average value are almost equal to each other. On the other hand, when an abrupt sound is received by the microphone 12, the short-time-average value becomes greater than the long-time-average value due to the noise spike. Therefore, it is possible to detect the occurrence of an abrupt sound in the surroundings of the user W on the basis of the comparison result indicating that the subtraction result obtained by the subtractor 124 is equal to or greater than the amplitude threshold value thA.

On the other hand, the level analyzer 126 detects that the level of the output signal from the LPF 121, that is, the level of the signal having a frequency component of 100 Hz or less has continued in a substantially constant state for about 100 milliseconds. The level analyzer 126 outputs the detection result to the determiner 127.

Specifically, the level analyzer 126 operates as follows. The level analyzer 126 incorporates a counter. The level analyzer 126 determines that the level of the output signal from the LPF 121 is substantially constant, for example, when the level of the output signal from the LPF 121 is within a range which is equal to or greater than a threshold value th1 and is lower than a threshold value th2 that is greater than the threshold value th1. The level analyzer 126 starts the counter when the level of the output signal from the LPF 121 moves into the range, to determine whether or not the count result of the counter exceeds 100 milliseconds. When the level of the output signal from the LPF 121 deviates from the range, the counter is reset in order to set the count value of the counter to zero.

The determiner 127 determines that the knocking sound occurs when an abrupt sound is detected by the comparator 125 and when the level of the output signal from the LPF 121 continues to remain in a substantially constant state for about 100 milliseconds. Upon determining that the knocking sound has occurred, the determiner 127 supplies the command Rcom corresponding to the knocking sound to the signal processor 102. The signal processor 102 mutes the signal Rin according to the command Rcom. Therefore, the speaker 15 changes to a silent state.

As described above, according to the headphones 1, when the user W wants to give a mute instruction, the user W may knock on the user's own cheek, as shown in FIG. 3, without directly operating the headphones 1.

Although the microphone 12 has not been specifically described, the microphone 12 can be used for causing the user W to actively listen to ambient sound, or for reducing ambient sound by inverting the phase of the sound signal output from the microphone 12 (in a reversed phase) and adding the inverted sound signal to the signal from the playback device 200 (so-called noise canceling function). For this reason, in the headphones 1, it is not necessary to provide an element unrelated to sound, such as an acceleration sensor described above. Therefore, cost increase can be minimized.

In addition, the casing (the base unit 3) of the headphones 1 or the like is not directly struck in order to input a command. Therefore, displacement of the casing is not likely to occur. For this reason, according to the headphones 1, the user does not have to return the headphones 1 to the original wearing position thereof after knocking is carried out. Therefore, reduction of usability for the user is prevented.

In the first embodiment, muting is given as an example of a command for the headphones 1. Another example is an instruction to activate an effecter that emphasizes a low tone, or the like. If the instruction to activate the effecter is used as a command, the signal processor 102 may turn the effecter on when the command Rcom is output, and may turn the effecter off when the command Rcom is output again.

It is of note that although the right unit 10R has been described herein, the left unit 10L also has the same configuration, except that the signal Lin is supplied by the receiver 152 and the command Lcom is output.

In a case in which each of the commands Rcom and Lcom is output independently, only a left channel may be muted when knocking only on the left cheek is detected, and only a right channel may be muted when knocking only on the right cheek is detected.

In addition, when one of the commands Rcom and Lcom is output, both the signal processor 102 of the right unit 10R and the signal processor 102 of the left unit 10L may be instructed to perform the processing.

In this configuration, the knocking on one of the right cheek and the left cheek causes both the right and left channels to be muted.

Next, a second embodiment will be described. In the first embodiment, the command designates a processing for the headphones 1, but in the second embodiment, the command designates a processing for the playback device 200.

The command for the playback device 200 is, for example, an instruction for playback, stopping, or skipping of music etc. The second embodiment is different from the first embodiment only in electrical configuration, and it is otherwise the same. Thus, in the second embodiment, differences in the electrical configuration will be mainly described.

Figure 6:
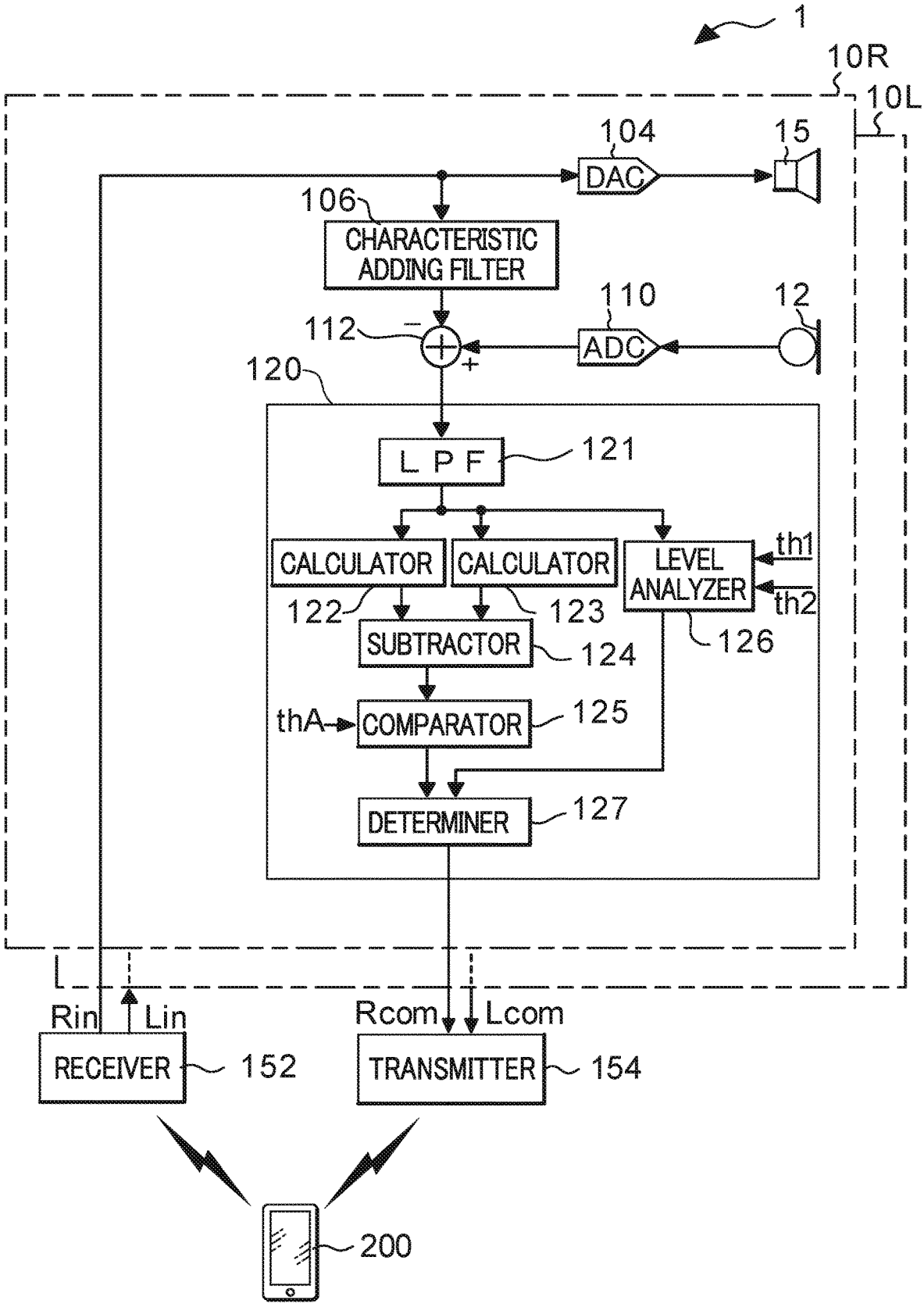
FIG. 6 is a block diagram showing an electrical configuration of the headphones according to a second embodiment.

FIG. 6 is a view showing an electrical configuration of the headphones according to the second embodiment. FIG. 6 differs from FIG. 5 in that the signal processor 102 is eliminated. Another difference is that there is provided a transmitter 154 that receives the commands Rcom and Lcom.

Since the headphones 1 according to the second embodiment does not have the signal processor 102, the signal Rin (Lin) from the receiver 152 is supplied to both the characteristic imparting filter 106 and the DAC 104.

The transmitter 154 transmits, to the playback device 200, the command Rcom supplied from the determiner 127 of the right unit 10R and the command Lcom supplied from the left unit 10L.

In a manner similarly to the receiver 152, the transmitter 154 may be incorporated into the band 20 or may be incorporated into the right unit 10R or the left unit 10L. The transmitter 154 may transmit a command to the playback device by use of a wire instead of wirelessly or via infrared.

In the headphones 1 according to the second embodiment, when the user W inputs a command to the playback device 200, the user W may knock on the user's own cheek as shown in FIG. 3 even when the playback device 200 is accommodated in a bag or a pocket. Therefore, in the second embodiment, there is no need for the user W to take out the playback device 200 from the bag or the like so as to operate the playback device.

When the command for the playback device 200 is an instruction for playback, stopping, skipping of music, or the like, the command does not designate separate processings for each of the left and right channels. Therefore, upon receipt of one of the commands Rcom and Lcom, the transmitter 154 may output the received command as a command for the playback device 200.

On the other hand, when the command for the playback device 200 designates a different processing for each of the left and right channel, the transmitter 154 may output the received command as either the command Rcom or Lcom in a distinguishable manner.

In the first and the second embodiments, a user knocks on the user's own cheek in inputting a command. However, the region to be knocked is not limited to a cheek. The region to be knocked on may be a part, such as auricle, earlobe, and tragus, in the vicinity of regions on which the right and left units 10R and 10L are positioned.

Further, in the first and the second embodiments, a knocking action performed on the user W is given as an example of an action in inputting a command. However, any action that generates a sound when the user W is touched, such as rubbing, may be used. That is, in inputting a command, any action may be used if such an action generates a sound that can be distinguished from environmental sounds among sounds received by the microphone 12, and if that sound is generated as a result of a touching action on the user W.

The command is not limited to one type. Specifically, a command depending on a type of touch sound determined from among a plurality of types of sounds may be output as long as a type of touch sound produced when a touch on the user W is made can be determined based on the number of touch sounds, amplitude, frequency characteristics, duration of the sound, etc.

The band 20 need not necessarily be provided in the headphones 1. Therefore, the headphones 1 may employ an earphone type that is without the band 20. When the earphone type headphones are used, the right unit 10R and the left unit 10L may be connected by signal to each other wirelessly. In this configuration, for example, the receiver 152 may be arranged on one of the right unit 10R and the left unit 10L, and the transmitter 154 may be arranged on the other.

The following can be understood in view of the embodiments described above, in particular, from the viewpoint of preventing reduction in usability for a user.

First, the disclosure is understood to be headphones that include a speaker configured to output sound on the basis of an input signal, a microphone configured to receive touch sound produced when a touch is performed on a user, and a command output device configured to, on the basis of a sound signal derived from the touch sound received by the microphone, determines a touch operation corresponding to the touch performed on the user, to output a command corresponding to the touch operation. According to the above-described headphones, the user need not touch the headphones in order to input a command. Accordingly, displacement of the casing is not likely to occur when a command is input. Therefore, reduction in usability is prevented.

Preferably, in the headphones, the command may be an instruction to control an external device that supplies the input signal or an instruction to process the input signal.

The headphones may further include a characteristic imparting filter configured to impart a predetermined characteristic into the input signal, and a subtractor configured to subtract a signal to which the characteristic has been imparted from the received sound signal. The command output device may determine the touch operation on the basis of an output signal of the subtractor.

In the headphones, the command output device may include a low pass filter configured to cut a predetermined high frequency region of the input signal, and a comparator configured to compare, with a predetermined threshold value, a difference between a short-time-average value of an amplitude of an output signal of the low pass filter and a long-time-average value of the amplitude.

In the headphones, the command output device may output the command when the difference is equal to or greater than the threshold value and when the state in which a power of the output signal of the low pass filter is within a predetermined range continues for a predetermined time.

DESCRIPTION OF REFERENCE SIGNS

1: Headphones, 10R: Right unit, 10L: Left unit, 12: Microphone, 15: Speaker, 106: Characteristic imparting filter, 120: Command output device, 121: Low pass filter, 122: Calculator, 123: Calculator, 124: Subtractor, 125: Comparator, 126: Level analyzer, 127: Determiner.

What is claimed is:

1. Headphones comprising:

a speaker configured to output sound based on an input signal;

a microphone configured to receive touch sound produced when a touch is performed on a user; and a command output device configured to, based on a sound signal, representing the touch sound picked up by the microphone, received from the microphone, determine a touch operation corresponding to the touch made on the user, and output a command corresponding to the touch operation, wherein the command output device includes:

a low pass filter configured to cut a predetermined high frequency region of the input signal; and a comparator configured to compare, with a predetermined threshold value, a difference between a short-time-average value of an amplitude of an output signal of the low pass filter and a long-time-average value of the amplitude, and wherein the command output device outputs the command upon:

the difference being equal to or greater than the predetermined threshold value; and a state where a power of the output signal of the low pass filter continues to be within a predetermined range for a predetermined time.

2. The headphones according to claim 1, wherein the command is an instruction to control an external device that supplies the input signal or an instruction to process the input signal.

3. The headphones according to claim 1, further comprising:

a characteristic imparting filter configured to impart a predetermined characteristic to the input signal; and a subtractor configured to subtract a signal to which the characteristic has been imparted from the sound signal, wherein the command output device determines the touch operation based on an output signal of the subtractor.

* * * * *